US005915873A

United States Patent [19]

Karlis

[11] Patent Number: 5,915,873

[45] Date of Patent: Jun. 29, 1999

[54] ROTATABLE WRITING SUPPORT NOTEBOOK INSERT

[75] Inventor: Robert G. Karlis, Hingham, Mass.

[73] Assignee: Clix Products, Inc., Natick, Mass.

[21] Appl. No.: 08/922,624

[22] Filed: Sep. 3, 1997

Related U.S. Application Data

[63] Continuation-in-part of application No. 08/647,218, May 9, 1996, abandoned.

[51] Int. Cl.[6] ..... B42F 13/00

[52] U.S. Cl. ..... 402/79; 402/80 R; 281/38

[58] Field of Search ..... 402/79, 111, 80 L, 402/80 R, 80 P; 248/441.1, 451, 456; 281/33, 38; D19/33, 88; 24/450, 457, 458, 15

[56] References Cited

U.S. PATENT DOCUMENTS

| | | | |
|---|---|---|---|
| 4,502,658 | 3/1985 | Wirt et al. . | |
| 4,940,353 | 7/1990 | Osono et al. . | |
| 5,044,807 | 9/1991 | Meservy et al. . | |
| 5,048,869 | 9/1991 | Schwartz . | |
| 5,101,540 | 4/1992 | Roof et al. | 24/458 |
| 5,114,259 | 5/1992 | Meservy et al. | 402/80 |
| 5,118,213 | 6/1992 | Meservy et al. . | |
| 5,219,239 | 6/1993 | Bianco . | |
| 5,233,900 | 8/1993 | Fitzgerald . | |
| 5,240,340 | 8/1993 | Lynch et al. . | |
| 5,476,336 | 12/1995 | Osiecki et al. . | |

*Primary Examiner*—Frances Han
*Attorney, Agent, or Firm*—Morse & Altman

[57] ABSTRACT

A notebook insert for use in a notebook that has a front cover and a back cover hingedly connected to an elongated spine where the spine has either at least two axially-aligned, openable rings evenly spaced longitudinally along the spine or a helical coil. The notebook insert includes a C-shaped frame and a rectangular support. The frame has a center portion and a pair of substantially equal-length arms, where the center portion has a plurality of openings near one edge for receiving the notebook rings and/or a plurality of catches for projecting through the loops of the coil. The support is pivotally connected to the frame by at least two axially-aligned, snap-together journals. The outer bearing surface of each journal is defined by the inner surface of a cylindrical depression located in a protrusion from one of support surfaces, where the cross section of the cylindrical depression forms an arc greater than 180°. The inner bearing surface is the surface of a cylinder connected between the opposite edges of a notch in the remote end of one of the arms.

17 Claims, 9 Drawing Sheets

ROTATABLE WRITING SUPPORT NOTEBOOK INSERT

RELATED APPLICATIONS

The present application is a continuation-in-part application of application Ser. No. 08/647,218, dated May 9, 1996 for ROTATABLE WRITING PLATFORM NOTEBOOK INSERT in the name of Robert G. Karlis now abandoned.

BACKGROUND OF THE INVENTION

1. Field of the Invention

The present invention relates to insertable writing surfaces for notebooks, more specifically, to writing surfaces that can be inserted into ringed and/or spiral notebooks and that are rotatable so that the writing surface can be used while viewing either page of an open notebook.

2. The Prior Art

The art of notebook inserts discloses a number of different ways of providing a person with a surface hard enough for writing on that can be inserted into a notebook. Three such notebook inserts are disclosed in U.S. Pat. No. 5,118,213 entitled DEMOUNTABLE WRITING TABLE FOR A NOTEBOOK issued to Meservy et al., U.S. Pat. No. 5,048,869 entitled HYPERTEXT BOOK ATTACHMENT issued to Schwartz, and U.S. Pat. No. 5,219,239 entitled ROTATABLE BINDER INSERT issued to Bianco. Meservy '213 discloses a platform that is inserted into the rings of a notebook and that provides a writing surface. A riser is held by the notebook rings in an upright position, essentially tangent to the notebook rings. The writing surface is rotatably attached at one edge to the riser The platform simply provides a hard surface for writing on paper that resides in the ringed notebook. When used as shown in the '213 disclosure, with fingers 24 and 25 engaged in the rings, the platform will not lay flat within the notebook without first removing it from the rings and replacing it without the fingers engaging the rings.

Schwartz '869 discloses a book attachment that mounts in the binding of a book via a long rigid rod. The book attachment provides sheets and a hard surface that either extend beyond the book pages or that reside within the book pages. When the attachment is used in the extended manner, it requires much more tabletop area than the book alone.

Bianco '239 discloses a rotatable notebook insert that includes a C-shaped frame that snaps into the rings of a notebook and a surface that rotates within the arms of the frame. The axis of rotation is defined by a pair of opposed pins extending from the upper and lower edges of the rotating surface that fit into mating holes in the frame arms. The design of the pins allows the surface to rotate 360° about the axis. The surface is held planar with the frame by a depression in a side edge of the surface that mates with a protrusion from the edge of the frame cross piece. Depressions on opposite edges of the surface hold the surface in either of two position 180° of rotation from each other. The main drawback of this design is that the pins form the only built-in support for the rotating surface. A relatively small amount of pressure on the rotating surface without firm support behind it can cause the pins to snap off, destroying the device.

Thus, there continues to be a need for device that can be inserted into a ringed or spiral notebook that provides a sturdy surface for writing and that can be rotated so that the same side can be used regardless of which side of the notebook is being viewed.

SUMMARY OF THE INVENTION

An object of the rotatable writing platform notebook insert of the present invention is to overcome the drawbacks of the prior art notebook inserts. One form of the notebook insert is intended to be used in a ringed notebook with two covers hinged to a spine. Axially-aligned, openable rings are evenly spaced longitudinally along the inside surface of the spine. A second form of the notebook insert is intended to be used in a spiral notebook having a helical coil.

The notebook insert has two components, a support and a frame. The basic function of the support is to provide a hard smooth surface for writing and/or holding a sheet of paper for viewing. The support is pivotally attached to the frame, which retains the support in the notebook.

The support is a substantially flat sheet of a substantially rigid plastic. Preferably, at least a portion of both support surfaces is smooth in order to function as a writing surface, as a surface for attaching self-adhesive removable note sheets, or as a surface for attaching instruments using microcatch patches. The support has a variety of possible embodiments in addition to the smooth surfaces. Any combination of these embodiments can be combined into a particular design for the support. In one embodiment, the support has a plurality of clips for securing sheets of paper. In another embodiment, an electronic data processing device, such as the calculator, is built into the support. Preferably, the electronic data processing device is solar-powered so that there is no need for a battery. In another embodiment, at least one compartment is molded into the support. In another embodiment, a plurality of leafs are bonded to the support surface, where the leafs are flat sheets, for example, sheets of transparent plastic having pockets for holding papers and/or photographs.

The frame is a C-shaped, flat sheet, preferably composed of a substantially rigid plastic. The frame has three portions, a center portion, a lower arm, and an upper arm. In one form, there are a plurality of cutouts in the center portion for temporarily securing the notebook insert into a ringed notebook. In another form, the center portion is provided with extending catches that project through the loops of a spiral notebook coil. These two forms may coexist on one frame. The arms extend perpendicularly from opposite ends of the center portion and are the same length. In one embodiment, the height of the frame and support are approximately the same height. In an alternate embodiment, the frame extends above the support so that the frame can act as a marker in the notebook.

The axis about which the support pivots is implemented by journals at the ends of the arms and on or near the vertical center line of the support. The journal inner bearing preferably includes a pair of aligned cylinders at the outer edge of the arm that are attached to the arm at the center edges of a pair of notches in the end of the arm. The journal outer bearing is located on the support center line and includes a pair of aligned concave cylindrical surfaces adapted to mate with the inner bearing, the cross section of which extends over an arc of between 190° and 250°. The journal is assembled by aligning the cylinders with the concave surfaces and snapping the components together. The journal design limits the support to rotating in a 180° arc about the frame, rather than a full 360°. When the support is at either of the extremes of its rotation, portions of the support adjacent to its upper and lower edges are in contact with the frame, providing a supported surface for writing. Unlike the notebook inserts of the prior art, if pressure should be applied to the support, the chance that the support will snap away from the frame is minimized. Also unlike the prior art, if the support should snap away from the frame, the notebook insert of the present invention is not destroyed but can be reassembled by snapping the journal back together.

BRIEF DESCRIPTION OF THE DRAWINGS

For a fuller understanding of the nature and object of the present invention, reference is made to the accompanying drawings, wherein.

DETAILED DESCRIPTION

Figure 1:
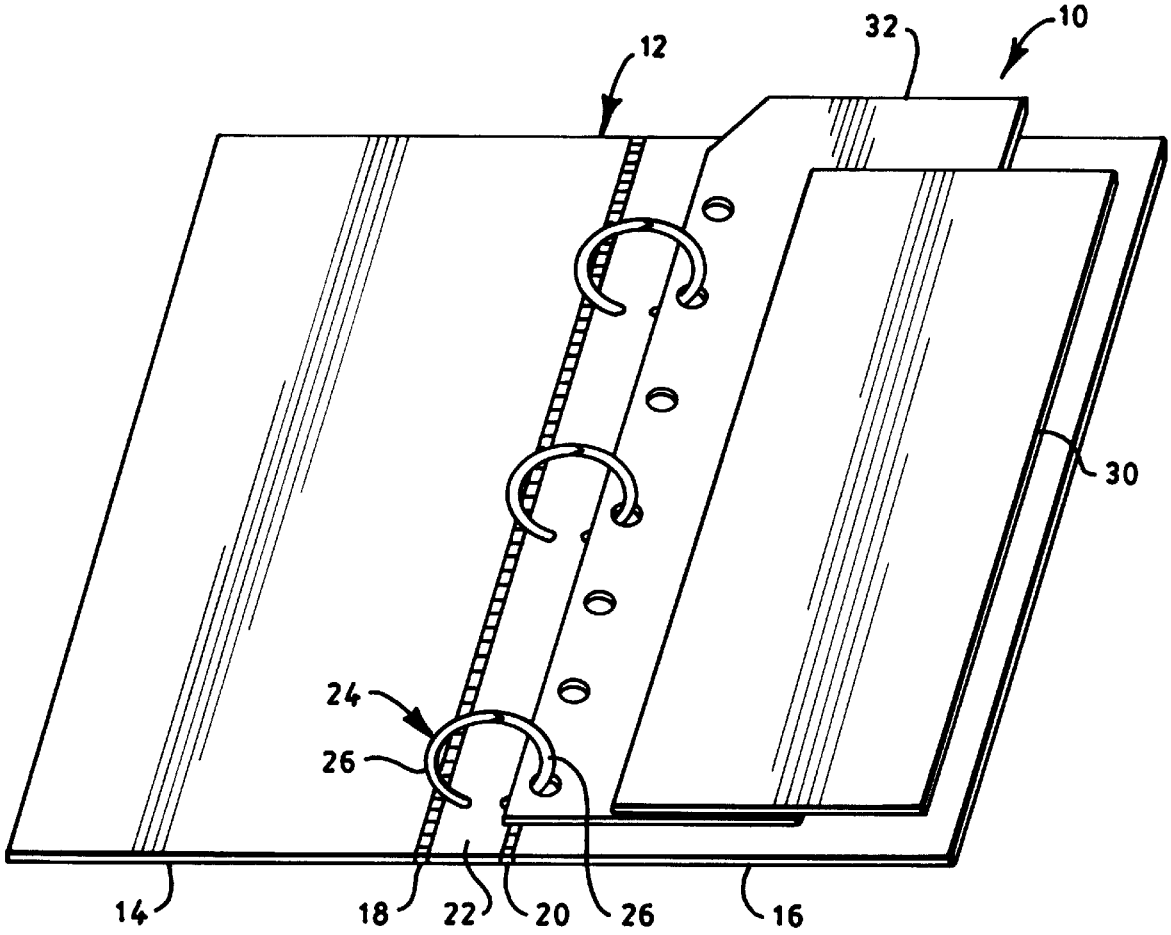
FIG. 1 is a perspective view of the present invention in a ringed notebook.
Figure 2:
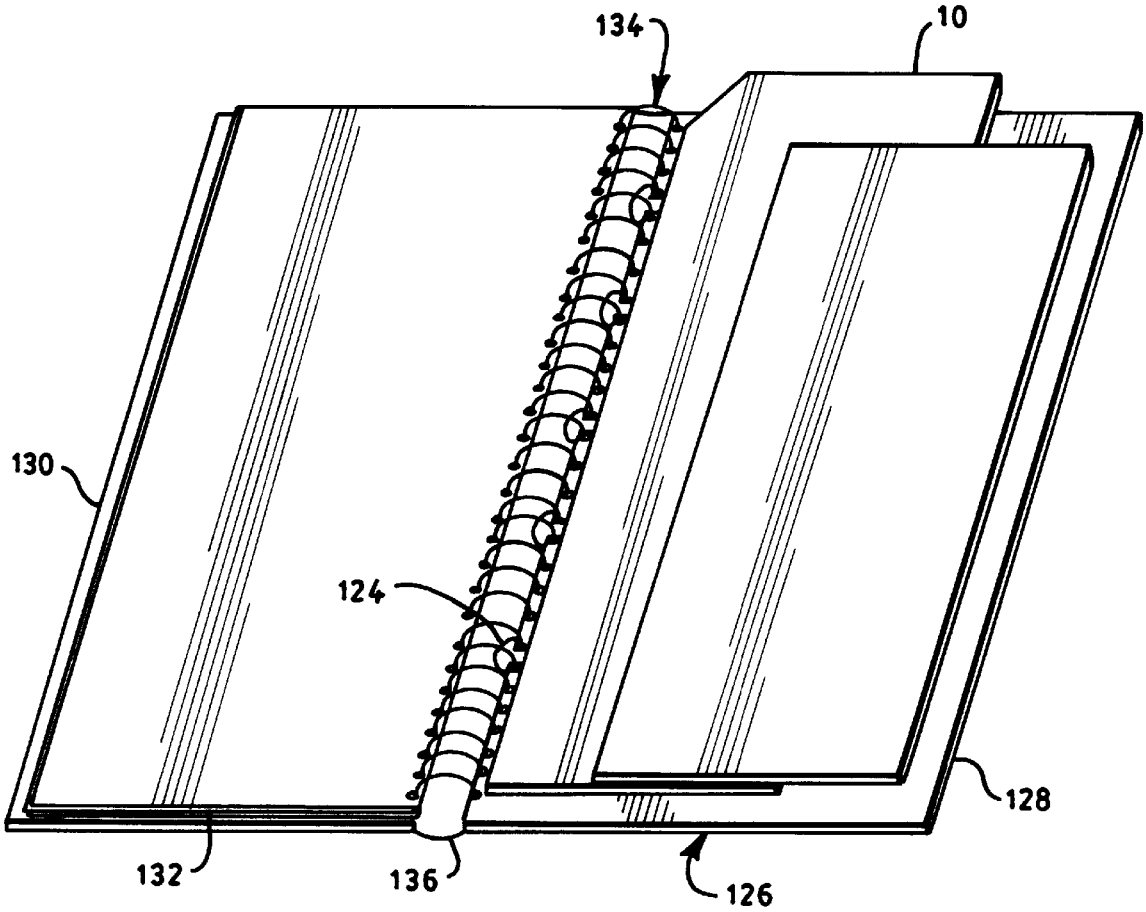
FIG. 2 is a perspective view of the present invention in a spiral notebook.

The rotatable writing platform notebook insert of the present invention 10 is intended to be used in a ringed notebook 12, such as the one shown in FIG. 1, or a spiral notebook 126, such as the one shown in FIG. 2. The ringed notebook 12 has two substantially rectangular cover panels 14, 16, each attached by a hinge 18, 20 to an elongated spine panel 22. At least two axially-aligned, openable rings 24 are evenly spaced longitudinally along the inside surface of the spine panel 22. The rings 24 are typically spring-loaded so that the two legs 26 of the ring 24 snap shut on the application of a small amount of pressure. The most common ringed notebook size in the United States is designed for punched paper sheets that are 8½×11 inches in dimension. However, smaller and other dimensioned ringed notebook sizes and shapes are contemplated by the present invention.

The spiral notebook 126 has two substantially rectangular cover panels 128, 130, a plurality of sheets of paper 132, and a spine in the form of a helical metal or plastic coil 134. The sizes of such spiral notebook 126 vary widely.

Figure 3:
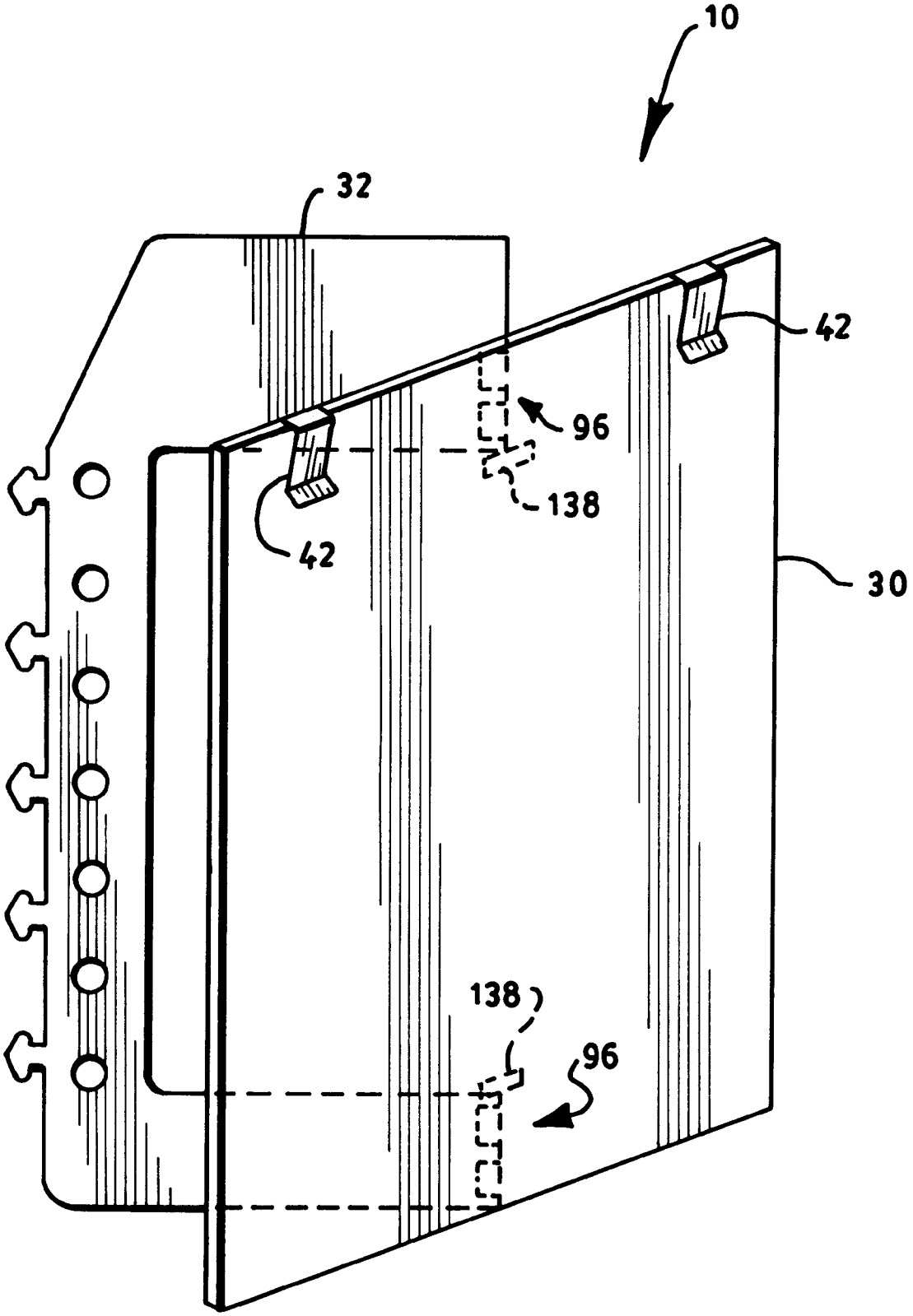
FIG. 3 is a perspective view of the present invention partially in phantom.

The notebook insert of the present invention 10, one embodiment of which is shown in FIG. 3, includes two components, a support 30 and a frame 32. The support 30 has one or more of several functions depending on the particular embodiments implemented, including a hard surface for writing and holding a sheet of paper for viewing. The frame 32 retains the support 30 in the notebook 12 described above. The support 30 pivots substantially 180° about the frame 32 along an axis substantially parallel to the notebook spine 22.

Figure 4:
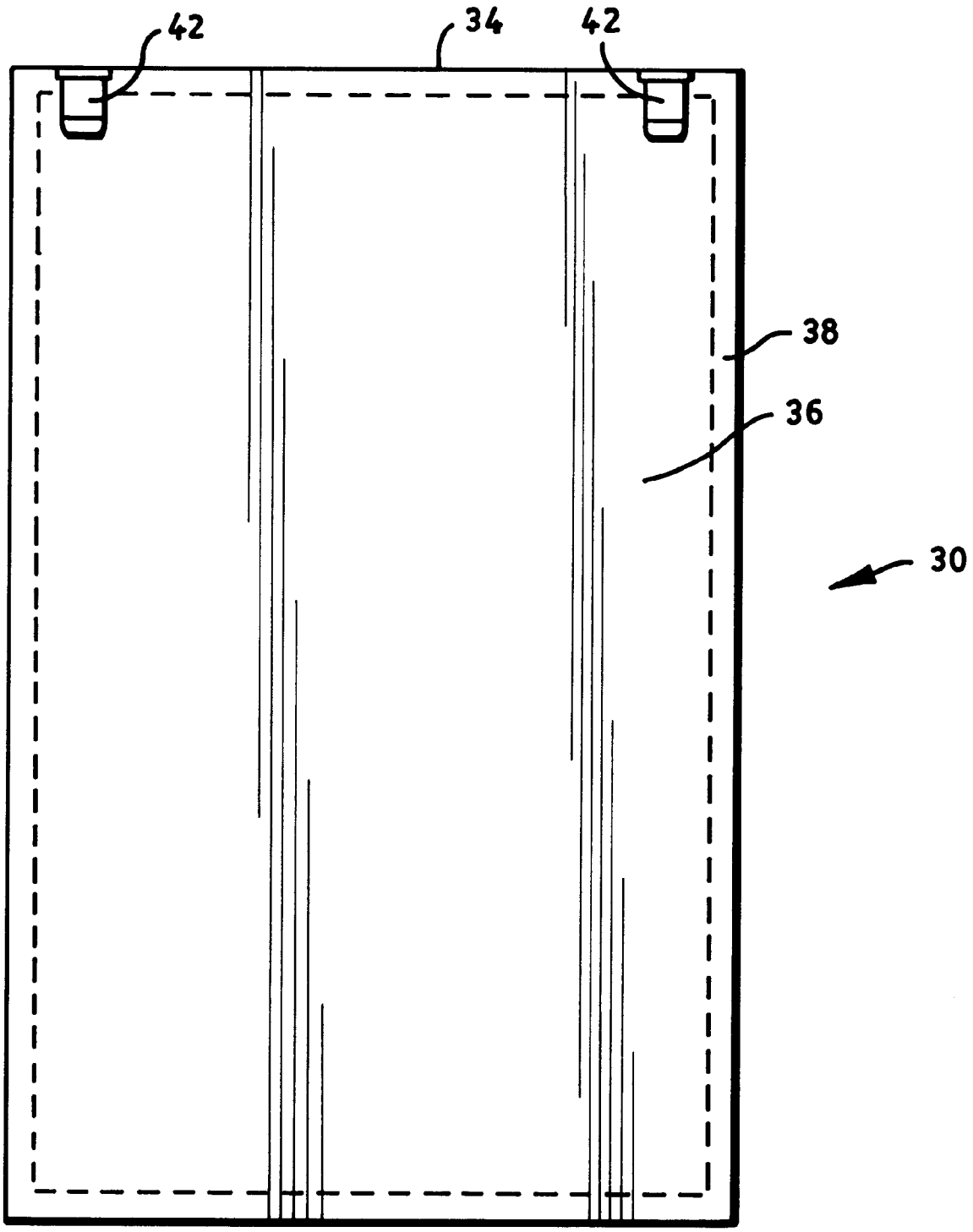
FIG. 4 is a front view of one embodiment of the support of FIG. 3.
Figure 5:
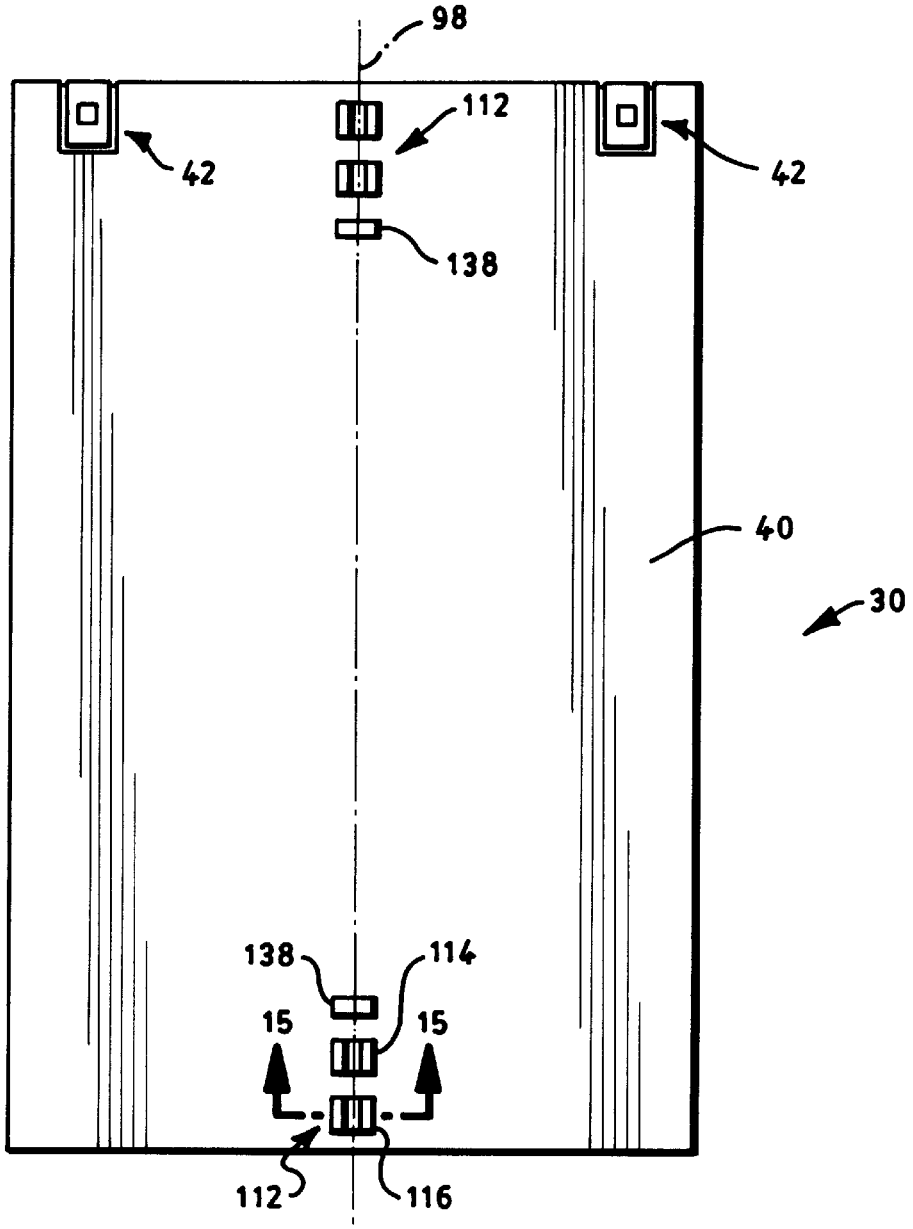
FIG. 5 is a rear view of the support of FIG. 3.

The support 30, shown in FIGS. 4 and 5, is a substantially rectangular, flat sheet 34, preferably composed of a substantially rigid plastic, such as polyethylene or high-impact styrene. The size of the sheet 34 depends upon the size of the sheet of paper that is to be held (shown in phantom at 36) and the size of the notebook 12 into which the notebook insert 10 is to be inserted. Preferably, at least a portion of one support surface 38 is smooth in order to function as a writing surface, as a surface for attaching self-adhesive removable note sheets, or as a surface for attaching a microcatch patch to which a device with a mating microcatch patch is attached.

The support 30 has a variety of possible embodiments in addition to the smooth surface. Any combination of these embodiments can be combined into a particular design for the support 30. In one embodiment, shown in FIGS. 4 and 5, the support 30 includes a plurality of clips 42 for securing sheets of paper 16. Preferably, there are two clips 42, one located near each upper corner of the support 30. The actual number of clips 42 in any particular embodiment of the present invention can vary and will generally depend on the size of the paper 36 that is intended to be secured; the larger the paper 36, the more clips 42 may be needed.

Figure 6:
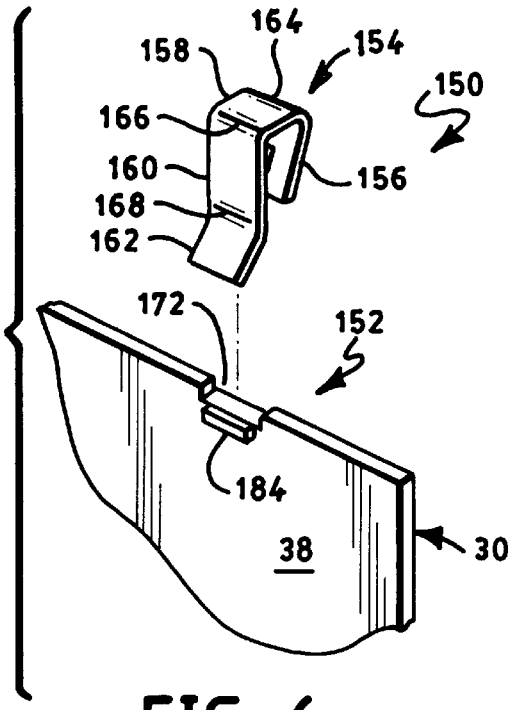
FIG. 6 is an exploded, front perspective view of a first clip embodiment.
Figure 7:
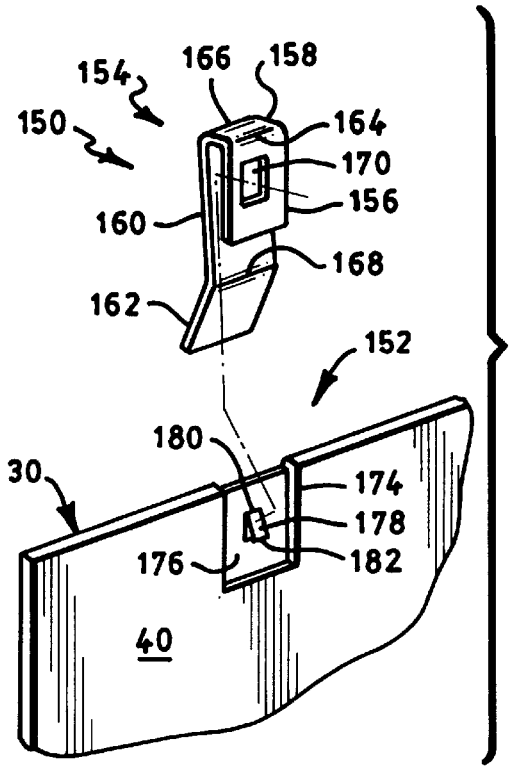
FIG. 7 is an exploded, rear perspective view of the clip embodiment of FIG. 6.

There are two embodiments of the clip 42. The first embodiment is shown in FIGS. 6 and 7. This clip 150 includes a part 152 molded into the support 30 and a metal part 154 that fits into the molded part 152. The metal part 154 is a length of thin sheet spring steel with three bends. A rear segment 156, top segment 158, and front segment 160 are formed by two of the bends 164, 166 such that the front bend 166 is at about 90° and the rear bend 164 is greater than 90°. The result is that the rear segment 156 and front segment 160 are not parallel but are farther apart at the top segment 158. The bottom segment 162 is formed at the bottom end of the front segment 160 by a lower bend 168 that bends away from the rear segment 156. There is a rectangular aperture 170 in the rear segment 156 for holding the metal part 154 to the molded part 152, as described below.

The molded part 152 includes a notch 172 in the edge of the support 30. The length of the notch 172 is slightly greater than the width of the metal part 154 and is deep enough to prevent the metal part 154 from sliding out of the notch 172. The notch 172 extends down the rear surface 40 of the support 30 as a depression 174 that is approximately the size and shape of the rear segment 156 of the metal part 154 so that the rear segment 156 fits into the depression 174. A protrusion 178 extends from the center of the depression 174 that fits into the aperture 170 in the rear segment 156. The upper edge 180 of the protrusion 178 is contiguous with the surface 176 of the depression 174 so that the metal part 154 can slide into the depression 174. The lower edge 182 of the protrusion 178 extends perpendicular from the depression surface 176 to latch the metal part 154 in place by hooking the aperture 170.

Just below the notch 172 and extending from the front surface 36 of the support 30 is a spacer 184. The sum of the height of the spacer 184 and the thickness of the support 30 at the depression 174 is about the same as the distance between the rear segment 156 and front segment 160 at the top segment 158. The spacer 184 keeps the upper end of the front segment 160 away from the support surface 38. When the metal part 154 is installed, the surface of metal part 154 at the lower bend 168 is in contact with the support surface 38 and the bottom segment 162 extends away from the support surface 38. The fact that the front bend 166 is greater than 90° causes the metal part 154 to push against the support surface with enough force to hold a sheet of paper. To insert the paper, the user pulls the bottom segment 162 away from the support surface 38, slides the paper between the metal part 154 and the support surface 38, and releases the metal part 154.

Figure 8:
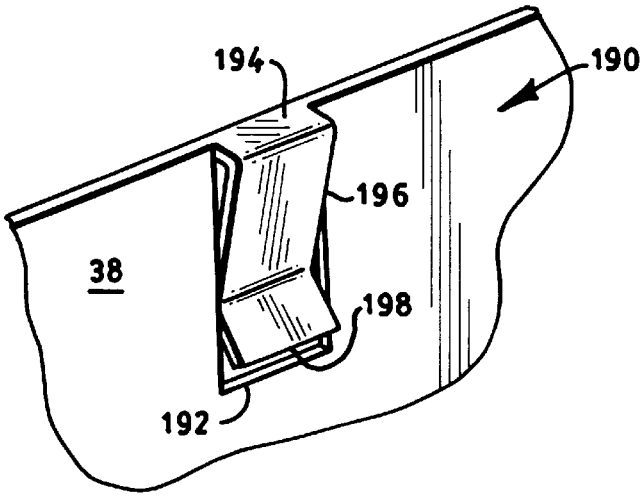
FIG. 8 is a perspective view of a second clip embodiment.
Figure 9:
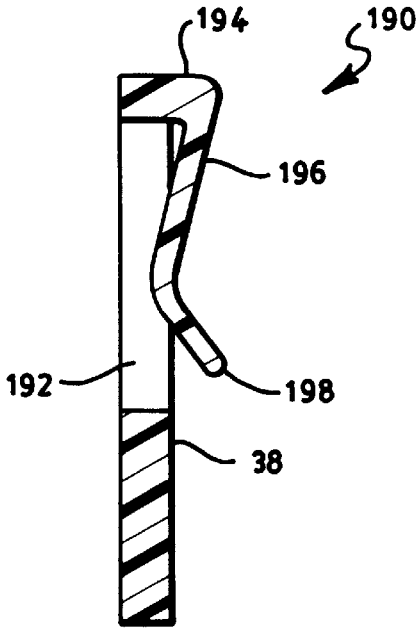
FIG. 9 is a cross-sectional view of the clip embodiment of FIG. 8 taken along the line 9—9.

The second clip embodiment is shown in FIGS. 8 and 9. This clip 190 is integrally molded into the support 30 and consists of an aperture 192, post 194, and finger 196. The aperture 192 is an opening in the support 30. The post 194 is located adjacent to the aperture 192 and extends a short length substantially perpendicularly from the front support surface 38. The finger 196 extends from the remote end of the post 194 over the aperture 192. The finger 196 is not parallel to the front support surface 38, but angles toward and extends into the aperture 192, preferably at an angle of less then 20°. The remote end of the finger 196 curves outward away from the aperture 192 until it is outside the plane of the front support surface 38.

The length of the aperture 192 is preferably about the same length as the finger 196. The width of the post 194 and finger 196 are substantially the same. The aperture 192 is slightly wider than the finger 196 so that the finger 196 can flex into and out of the aperture 192 without making contact with the sides of the aperture 44. The finger 196 has a thickness that provides both the flexibility to be manually bent outward from the front support surface 38 and the stiffness to hold a sheet of paper. A preferred thick is approximately 0.020 inch. The paper is held by the force of the finger 196 attempting to press the paper into the aperture 192. The friction of the finger 196 on the paper and the friction of the paper against the edges of the aperture 192 normally prevent the paper from moving.

Figure 10:
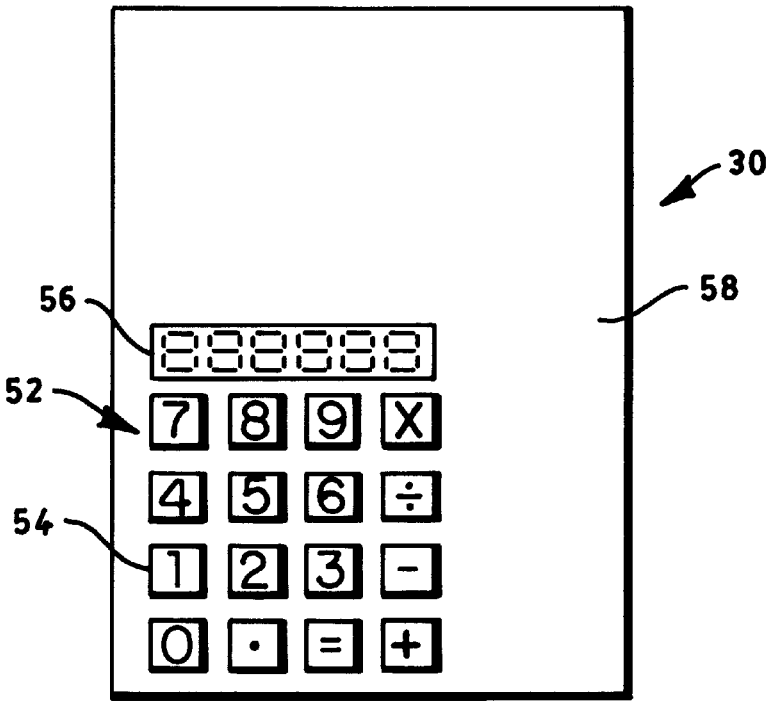
FIG. 10 is a front view of a second embodiment of the support of FIG. 3.

In a second support embodiment, an electronic data processing device, such as the calculator 52 shown in FIG. 10, is built into the support 30. Preferably, the electronic data processing device is solar-powered so that there is no need for a battery. This preference, however, does not preclude the use of a battery-powered electronic data processing device in any particular embodiment. Examples of preferred electronic data processing devices include a calculator, a language translator, a thesaurus, a speller, and a dictionary. Depending on the size of the support 30, the electronic device keyboard 54 and display 56 may only take up a portion of the support surface 58. The remainder of the support surface 58 is smooth to function as a writing surface and may include surface components from other embodiments of the support 30.

Figure 11:
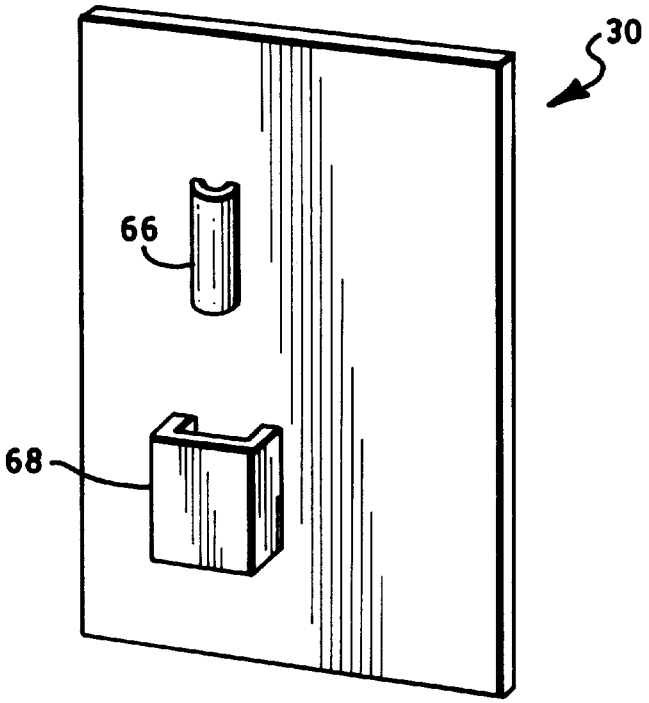
FIG. 11 is a perspective view of a third embodiment of the support of FIG. 3.

A third support embodiment includes at least one compartment in various locations for holding various stationery items, such as pens, pencils, erasers, rulers, small sheets of paper, etc. Two possible shapes of compartments 66, 68 are shown in FIG. 11. Preferably, the compartments are molded into the support 30.

Figure 12:
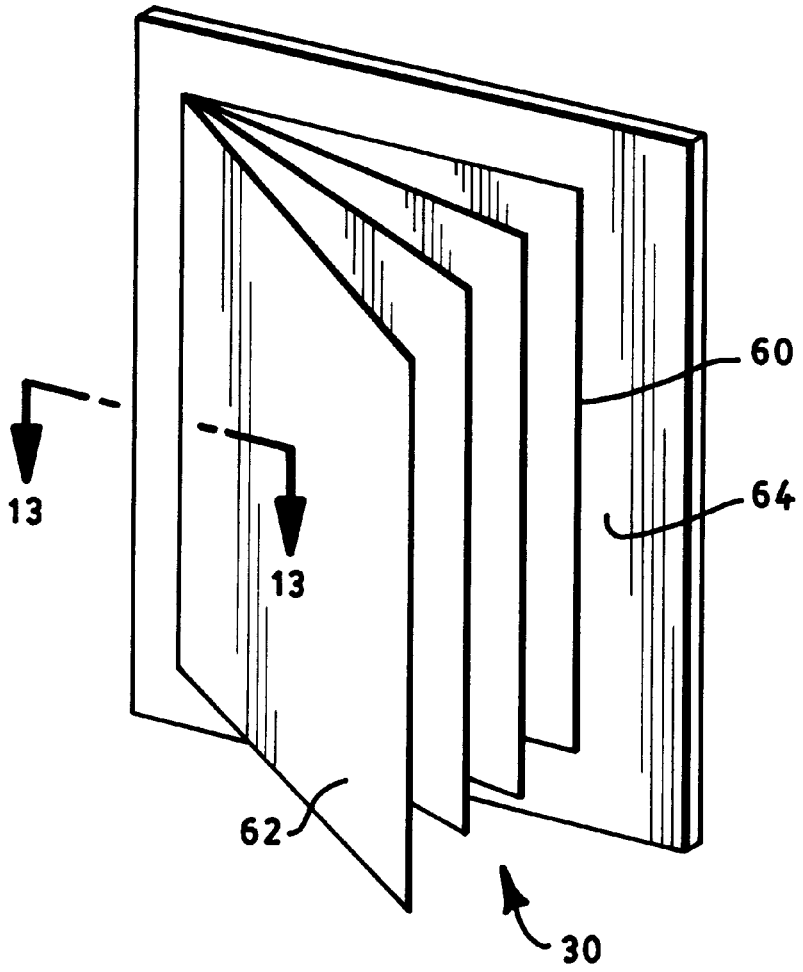
FIG. 12 is a perspective view of a fourth embodiment of the support of FIG. 3.
Figure 13:
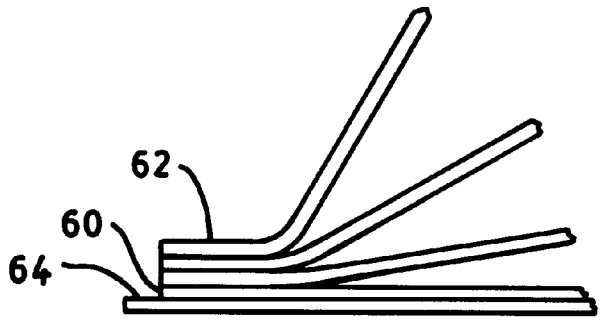
FIG. 13 is an enlarged, cross-sectional view of a portion of the support embodiment of FIG. 12 taken along the line 13—13.

A fourth support embodiment, shown in FIGS. 12 and 13, includes a plurality of leafs 60, 62 bonded to the support surface 64. One edge of the bottom-most leaf 60 is bonded to the support surface 64 near one edge and the edges of the remainder of the leafs 62 are bonded to each other in a stack on top of the bottom-most leaf 60. The leafs 60, 62 are flat sheets, for example, sheets of transparent plastic having pockets for holding papers and/or photographs.

Figure 14:
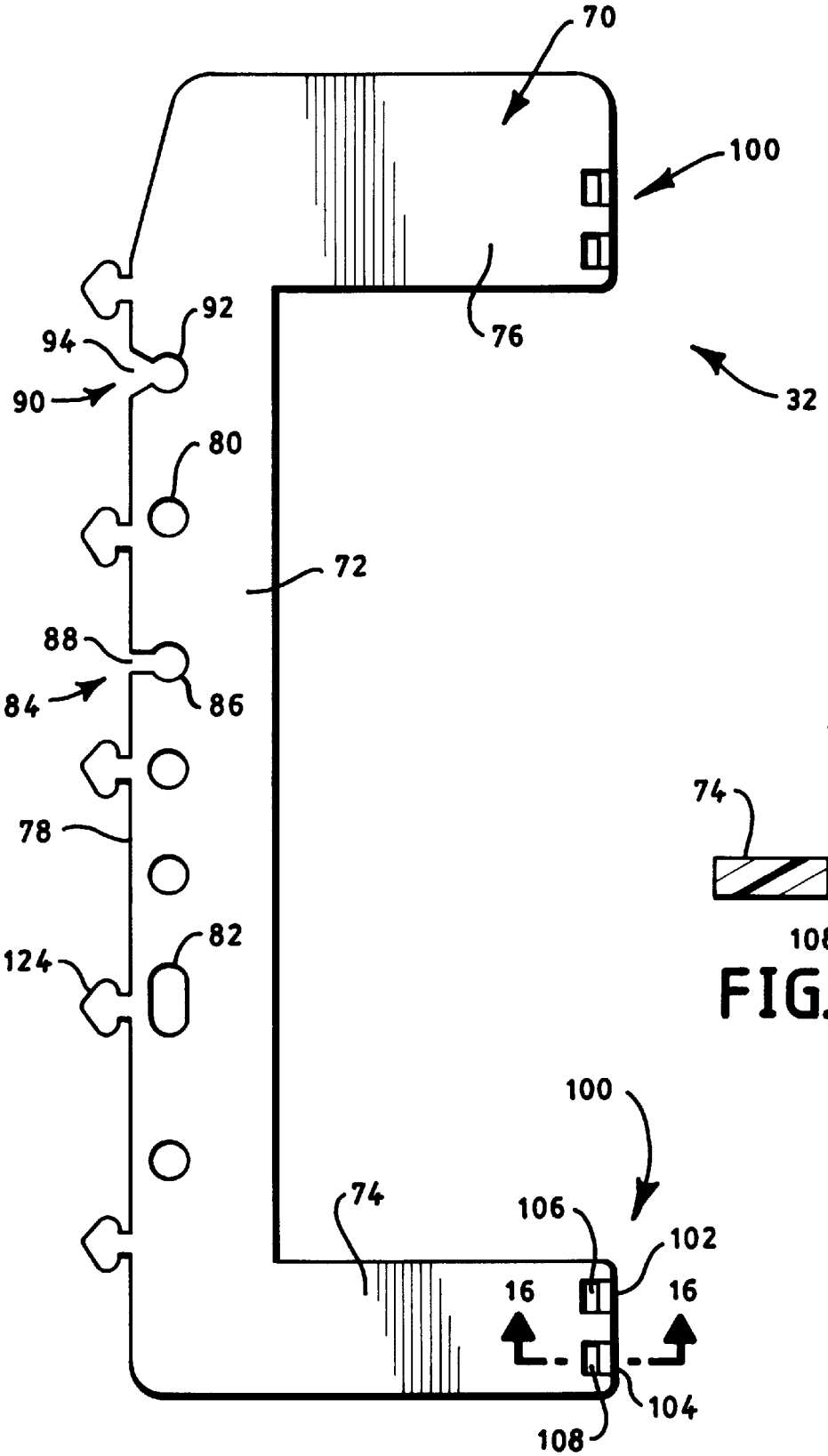
FIG. 14 is a front view of the frame of FIG. 3.

The support 30 is mounted in the notebook 12 by the frame 32, shown in FIG. 14. The frame 32 is a substantially C-shaped, flat sheet 70, preferably composed of a substantially rigid plastic, such as polyethylene or high-impact styrene. The frame 32 has three portions, a center portion 72, a lower arm 74, and an upper arm 76.

In one form of the frame 70, there are a plurality of cutouts adjacent to the outer edge 78 of the center portion 72 for temporarily securing the present invention 10 into the notebook 12. Each cutout has one of a variety of shapes and any particular frame 32 embodiment may have cutouts of more than one shape. FIG. 14 shows the different shapes for cutouts and is not intended to show a particular preferred combination of cutouts. The circular shape consists solely of a circular hole 80 in the interior of the center portion 72. Preferably, the circular hole 80 is located from the outer edge of the center portion 78 so that it does not interfere with the operation of the notebook 12. With this cutout, the notebook ring 24 into which the circular hole 80 is to be inserted is opened, typically by pulling the two ring legs 26 away from each other until they snap apart due to spring loading. The open end of one of the ring legs 26 is inserted into the circular hole 80 and the rings 24 are closed by applying inward pressure to the rings legs 26 until they snap together.

The slot shape 82 consists solely of an elongated hole in the interior of the center portion 72. Preferably, the long axis of the elongated hole 82 is parallel to the outer edge 78 of the center portion 72. Notebook inserts with this cutout are installed in the same manner as the circular hole cutout 80.

The open shape 84 consists of a circular hole 86 in the interior of the center portion 72 that is open to the outer edge 78. The opening to the outer edge is a slot 88 defined by a pair of parallel edges that are substantially perpendicular to the outer edge 78. The width of the slot 88 is smaller than the diameter of the circular hole 86. Typically, notebook inserts with this cutout are installed by pressing the notebook rings 24 into the slot 88 until it snaps into the circular hole 86. Alternatively, the notebook insert can be installed in the same manner as described above in reference to the circular hole cutout 80.

The keyhole shape 90 consists of a circular hole 92 in the interior of the center portion 72 that is open to the outer edge 78. The opening to the outer edge is a slot 94 defined by a pair of edges that are approximately radial to the center of the circular hole 92. The slot 94 at the circular hole 92 is narrower than the diameter of the circular hole 92. Notebook inserts with this cutout are installed in the same manner as those having the open shape 84, as described above.

In another form of the frame 70, there are a plurality of catches 124 extending from the outer edge 78 of the center portion 72 for temporarily securing the present invention 10 into the spiral notebook 126. The catches 124 are approximately spade-shaped and project through the loops 136 of the coil 134. The shape of the catches 124 allows the them to be inserted between the loops 136 relatively easily but prevent inadvertent removal of the catches 124 from the loops 136. Any particular embodiment of the present invention may have only catches, only cutouts, or both catches and cutouts.

The lower arm 74 extends perpendicularly from the bottom end of the center portion 72 and the upper arm 76 extends perpendicularly from the top end of the center portion 72. The lower arm 74 and upper arm 76 are substantially the same length. In one embodiment, the height of the frame 32 is substantially the same as the height of the support 30. In an alternate embodiment, shown in FIGS. 1 and 2, the frame 32 extends above the support 30 so that the frame 32 can act as a marker in the notebook 12 into which it is mounted.

Figure 16:
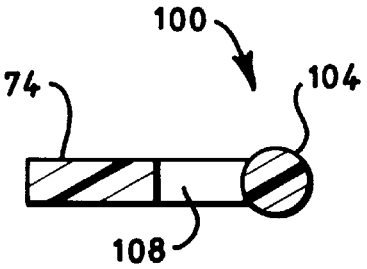
FIG. 16 is an enlarged cross-sectional view of an outer bearing of the support of FIG. 5 taken along the line 16—16.

The axis about which the support 30 pivots is implemented by journals 96 at the ends of the arms 74, 76 and on a line 98 of the support 30. The journal inner bearing 100, shown in FIG. 16, is located at the outer end of the arm 74, 76 and includes a pair of aligned cylinders 102, 104 at the edge of the outer end of the arm 74, 76. The cylinders 102, 104 are attached to the arm 74, 76 by the connection between the ends of the cylinders 102, 104 and the opposed side edges of a pair of notches 106, 108 in the end of the arm 74, 76. Preferably, the cylinders 102, 104 are integrally molded with the arm 74, 76.

Figure 15:
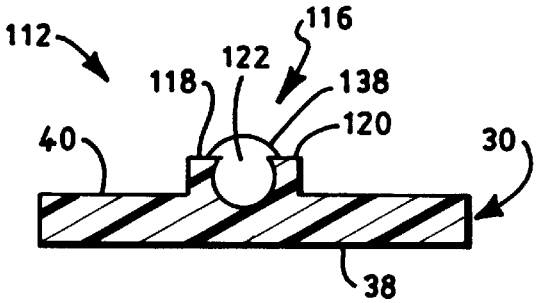
FIG. 15 is an enlarged, cross-sectional view of an inner bearing of the frame of FIG. 14 taken along the line 15—15.

The outer bearing 112 of the journal 96, shown in FIG. 15, is preferably located on the support vertical center line and includes a pair of aligned concave cylindrical surfaces 114, 116 adapted to mate with the inner bearing 100. Each concave cylindrical surface 114, 116 is formed by the inner surfaces of a pair of inwardly curving protrusions 118, 120 that extend from the rear support surface 40. Between the outer ends of the protrusions 118, 129 is a gap 122. Preferably, the concave cylindrical surfaces 114, 116 each have a cross-sectional inner diameter that is slightly larger than the diameter of the inner bearing cylinders 102, 104. Preferably, the cross section spans an arc of approximately 210°. The arc must be great enough that the inner bearing cylinders 102, 104 snap into and are retained by the outer bearing concave cylindrical surfaces 114, 116, but not so great that the inner bearing cylinders 102, 104 cannot be snapped into the outer bearing concave cylindrical surfaces 114, 116.

The outer bearing of the journal does not have to be along the vertical center line of the support. It may be located along any line, for example, along a vertical line offset from center. In this example, the distance that the support extends from the notebook spine depends on the rotational position of the support relative to the frame. The farther extending edge of the support can act, for example, as a bookmark when needed.

The journal 96 is assembled by aligning the cylinders 102, 104 with the opening between the corresponding two curving protrusions 118, 120 and snapping the cylinders 102, 104 into the gap 122 between the curving protrusions 118, 120.

When the support 30 is at either of the extremes of its rotation, which are 180° apart, portions of the support 30 adjacent to the upper and lower edges are in planar contact with the frame 32, providing a supported surface for writing. If pressure should be applied to the support 30, the possibility that the support 30 will snap away from the frame 32 is minimized. If the support 30 should snap away from the frame 32, the notebook insert of the present invention 10 is not destroyed, unlike the notebook inserts of the prior art; the inner journal bearing 100 and outer journal bearing 112 can merely be snapped back together.

When the support 30 is at its center position relative to the frame 32, the design of the journals 96 would permit the support 30 and frame 32 to side apart along the pivot axis. To prevent this, a pair of stops 138 extend from the support surface 40 in the same direction as the outer journal bearings 112. The preferred position is along the line of the pivot axis 98 and inboard of the outer journal bearings 112, as in FIG. 5. The stops 138 are positioned so that the inner edge of the upper and lower frame arms 74, 76 abut the stops 138, preventing the frame from sliding along the pivot axis a significant amount.

OPERATION

The notebook insert of the present invention 10 is installed in a ringed notebook 12 or spiral notebook 126. How it is installed in a ringed notebook 12 depends on the form of the holes of the notebook insert frame, as described above. In a spiral notebook 126, the catches 124 are forced between the coil loops 136.

The notebook insert 10 is moved from one side of the notebook to the other side like any other page of the notebook. Both surfaces of the support 30 are used by rotating the support 30 about the journal 96 until it is stopped by the overlapping portions of the frame 32.

Thus it has been shown and described a notebook insert which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A notebook insert for use in a notebook having a front cover and a back cover hingedly connected to an elongated spine, said notebook insert comprising:

(a) a C-shaped frame having a center portion and a pair of equal-length arms, each of said arms having at least one notch at an end remote from said center portion and said center portion including a configuration for connecting said notebook insert to said spine;

(b) a support having a first surface and a second surface, said support being pivotally connected to said frame by at least two axially-aligned journals, each of said journals including an inner bearing having an inner bearing surface and an outer bearing having an outer bearing surface;

(c) said inner bearing surface being the surface of a cylinder extending between opposed edges of said notch;

(d) said outer bearing surface being the inner surface of a substantially cylindrical depression located in a protrusion from said second surface, the cross-section of said cylindrical depression forming an arc that retains said cylinder; and (e) said journals having limits of rotation when said second surface is in planar contact with said arms, said configuration extending beyond said support when said journals are at said limits of rotation.

2. The notebook insert of claim 1 wherein said notebook includes at least two axially-aligned, openable rings spaced longitudinally along said spine and said configuration includes said center portion having a plurality of openings for receiving said rings.

3. The notebook insert of claim 1 wherein said spine includes a helical coil with loops and said configuration includes said center portion having catches for projecting through said loops and for prevention of inadvertent removal from said loops.

4. The notebook insert of claim 1 wherein said outer bearing is located on a center line of said second support surface.

5. The notebook insert of claim 1 wherein at least a portion of said first surface is smooth.

6. The notebook insert of claim 1 wherein at least said first surface includes a plurality of clips.

7. The notebook insert of claim 6 wherein said each of said plurality of clips includes a bent sheet of spring steel mounted to an edge of said support.

8. The notebook insert of claim 6 wherein each of said plurality of clips includes an aperture in said support and a finger extending from said support surface over said aperture.

9. The notebook insert of claim 1 wherein at least said first surface includes an electronic data processing device.

10. The notebook insert of claim 1 wherein at least said first surface includes at least one leaf, one edge of said leaf being bonded to said at least said first surface.

11. The notebook insert of claim 1 wherein at least said first surface includes at least one compartment.

12. A notebook insert for use in a notebook having a front cover and a back cover hingedly connected to an elongated spine, said notebook insert comprising:

(a) a C-shaped frame having a center portion and a pair of equal-length arms, each of said arms having at least one notch at an end remote from said center portion and said center portion including a configuration for connecting said notebook insert to said spine;

(b) a support having a first surface and a second surface, at least a portion of said first surface being smooth, said support being pivotally connected to said frame by at least two axially-aligned journals, each of said journals including an inner bearing surface and an outer bearing surface;

(c) said inner bearing surface being the surface of a cylinder extending between opposed edges of said notch;

(d) said outer bearing surface being the inner surface of a substantially cylindrical depression located in a protrusion on a center line of said second surface, the cross-section of said cylindrical depression forming an arc that retains said cylinder; and (e) said journals having limits of rotation when said second surface is in planar contact with said arms, said configuration extending beyond said support when said journals are at said limits of rotation.

13. The notebook insert of claim 12 wherein said notebook includes at least two axially-aligned, openable rings spaced longitudinally along said spine and said configuration includes said center portion having a plurality of openings for receiving said rings.

14. The notebook insert of claim 12 wherein said spine includes a helical coil with loops and said configuration includes said center portion having catches for projecting through said loops and for prevention of inadvertent removal from said loops.

15. The notebook insert of claim 12 wherein at least said first surface includes a plurality of clips.

16. The notebook insert of claim 15 wherein said each of said plurality of clips includes a bent sheet of spring steel mounted to an edge of said support.

17. The notebook insert of claim 15 wherein each of said plurality of clips includes an aperture in said support and a finger extending from said support surface over said aperture.

* * * * *